United States Patent [19]

Aske et al.

[11] Patent Number: 5,038,665

[45] Date of Patent: Aug. 13, 1991

[54] SILENT STUD GUN ATTACHMENT DEVICE

[75] Inventors: Robert L. Aske, St. Louis Park; Thomas R. Prentice, St. Paul, both of Minn.

[73] Assignee: Honeywell Inc., Minneapolis, Minn.

[21] Appl. No.: 474,884

[22] Filed: Feb. 2, 1990

[51] Int. Cl.[5] ..... B25C 1/14; E16B 15/00

[52] U.S. Cl. ..... 89/1.14; 227/9; 227/10; 411/441

[58] Field of Search ..... 89/1.14; 29/254; 227/9–11; 60/632, 635; 411/440, 411

[56] References Cited

U.S. PATENT DOCUMENTS

| | | | |
|---|---|---|---|
| 3,871,565 | 3/1975 | Termet | 227/10 |
| 3,895,752 | 7/1975 | Hatayama et al. | 227/10 |
| 3,901,155 | 8/1975 | Huber | 89/1.14 |
| 4,025,029 | 3/1977 | Kotas et al. | 227/10 |
| 4,038,924 | 8/1977 | Beermann et al. | 89/1.14 |
| 4,060,188 | 11/1977 | Monson | 227/9 |
| 4,068,790 | 1/1978 | Osterle et al. | 227/10 |
| 4,102,238 | 7/1978 | Thurner | 411/441 |
| 4,196,834 | 4/1980 | Beton | 60/635 |
| 4,252,259 | 2/1981 | Brosius | 227/10 |
| 4,271,747 | 6/1981 | Bendler et al. | 411/440 |
| 4,374,567 | 2/1983 | Combette et al. | 227/10 |
| 4,487,353 | 2/1984 | Benson et al. | 227/9 |
| 4,505,018 | 3/1985 | Regalbuto et al. | 29/254 |
| 4,651,912 | 3/1987 | Hawkins | 227/8 |
| 4,684,050 | 8/1987 | Masas | 227/10 |
| 4,802,802 | 2/1989 | Thurner | 411/441 |
| 4,830,252 | 5/1989 | Gottlieb et al. | 227/8 |
| 4,867,365 | 9/1989 | Buechel et al. | 227/10 |

*Primary Examiner*—David H. Brown

*Attorney, Agent, or Firm*—Merchant, Gould, Smith, Edell, Welter & Schmidt

[57] ABSTRACT

A propellant operated, single shot, silent stud gun attachment device used to attach various articles to structures. The device is particularly suited to use by military units for attachment of munitions or mines to structures such as bridges or buildings. The device utilizes an initiation device attached to a barrel in proximity to a cartridge containing a piston. The initiation of the cartridge is used to drive the piston into a stud and in turn drive the stud into a structure. The entire device becomes attached to the structure, thereby providing a means by which to quietly attach articles to the structure.

22 Claims, 3 Drawing Sheets

SILENT STUD GUN ATTACHMENT DEVICE

FIELD OF THE INVENTION

This present invention relates to a silent stud gun attachment device for fastening articles such as mines and munitions to bridges, buildings and other structures. The invention utilizes the burning of propellant or explosives within a barrel to silently propel a fastening stud or similar projectile through the article to be attached and into the structure of interest.

BACKGROUND OF THE INVENTION

In the related art, there are a number of types of stud gun devices which have been used to attach numerous types of articles to a variety of structures. Commonly the article to be attached is interposed between the stud gun and the structure to which the article is to be attached prior to firing the gun. Upon firing, the stud passes through the article, or an opening in the article, thereby pinning the article to the structure. These stud guns typically utilize the burning of propellant, such as the types of propellant used in small caliber hunting ammunition, to propel a nail-like stud or similar fastening device through a barrel and into the structure of interest. In some instances, the burning of the propellant is used to drive a piston-like device into the stud which in turn drives the stud into the structure of interest. The piston is used to increase the amount of force transmitted to the stud by the burning propellant.

A common characteristic of the stud gun devices found in related art is that they produce varying amounts of noise as they are operated due to the necessary expulsion of propellant gases from the gun. Various methods have been utilized to reduce the amount of noise generated by these stud guns. One method involves porting or redirecting the propellant gases within the stud gun, or its barrel, so that the gases are not directly ejected from the barrel when the stud gun is fired. This method has been reported to have reduced the noise output of stud guns which utilize this technique, but some noise is still generated due to the fact that the propellant gases eventually must exit the gun in order to avoid the buildup of pressure from the burned propellant. This pressure release is particularly necessary for stud guns which are designed to be used repeatedly. Multiple firing capability is another characteristic of stud gun devices cited in related art. Often the need for multiple uses results in stud gun designs which are larger, heavier and more ruggedly built than is required to provide a functional stud gun. Yet another characteristic of the stud gun devices found in related art is that they are usually designed to completely expel the stud or fastening projectile from the gun when it is fired. This feature of stud guns also creates safety problems having to do with the accidental expulsion of the stud if the gun is dropped or otherwise subjected to a jarring impact.

SUMMARY OF THE INVENTION

The present invention was developed for use by certain Special Forces units of the military. Some missions performed by these units require the attachment of a variety of mines or munitions to structures such as bridges and buildings. These missions require an attachment device such as a stud gun, which is silent, easily operated, safe and readily transportable. Stud guns available commercially did not meet these mission requirements.

The silent stud gun attachment device was developed to meet the Special Forces mission requirements mentioned above, by providing a stud gun which did not contain the limitations found in commercially available devices.

The silent stud gun attachment device, or silent stud gun, utilizes a burning propellant or explosive to propel the stud, or fastening projectile, through a housing or barrel into the structure of interest. The present invention also may incorporate a standard caliber cartridge to provide the propellant such as a .357 magnum cartridge. A piston may also be utilized to amplify the driving force provided to the stud, or fastening projectile, to propel it into the structure of interest.

A unique feature of the present invention however, is that the piston may be made of a high density material such as tungsten. This allows the utilization of a relatively small piston while still providing the needed force to the stud or fastening projectile of interest. Another unique feature of the present invention is that the piston may be actually crimped into the cartridge case in much the same way as a bullet would be if the cartridge were to be used in a small caliber weapon. The present invention also utilizes a seal or seals to prevent the burning propellant gases from escaping down the barrel and out into the external environment when the stud gun is fired. Such seals may take the form of O-ring seals around the stud, or other fastening projectile, the piston, or both. Yet another unique aspect of the present invention is that the barrel and stud are designed such that the stud is never completely expelled from the barrel. Therefore, once the stud gun is fired, the entire gun becomes in effect the attachment device. The present device is designed for one shot rather than multiple firings. The net result of the combination of features mentioned above provides a silent, safe, easily transportable stud gun fastening device.

BRIEF DESCRIPTION OF THE DRAWINGS

FIG. 1*a* is shown in the unfired condition.

DESCRIPTION OF THE PREFERRED EMBODIMENT

Stud guns are generally noisy devices owing to the burning of the propellant used to drive the stud. Some stud guns require the use of hearing protection. These devices are typically designed to be used more than once and often are rather large and heavy sometimes weighing several pounds or more. Stud guns generally expel the stud, or other fastening device, completely from the barrel. The stud expulsion feature can lead to a safety hazard because stud guns have been known to have rather minimal safing mechanisms, such that they can be accidentally discharged by dropping the gun or otherwise impacting the initiation or safing means. Current stud gun designs are generally unsuitable for use by Special Forces of the military due to the noted limitations.

This invention avoids or minimizes the shortcoming noted above by a unique combination of elements to provide a silent, relatively lightweight, small and safe attachment device. The invention also can be practiced by utilization of a number of commercially available components as demonstrated by the fact that FIGS. 1 through 4 indicate the use of a number of such components.

Figure 1B:
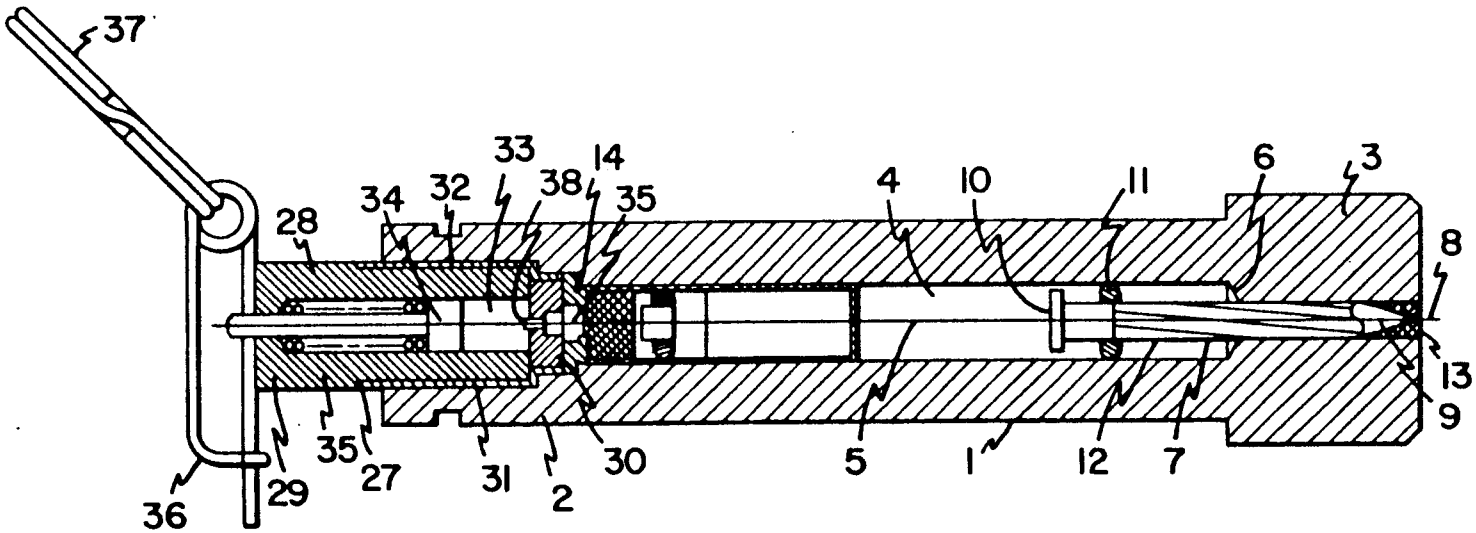
FIGS. 1*a* and 1*b* are a section view and an end view of one preferred embodiment of the silent stud gun attachment device assembled together according to the invention.
Figure 1A:
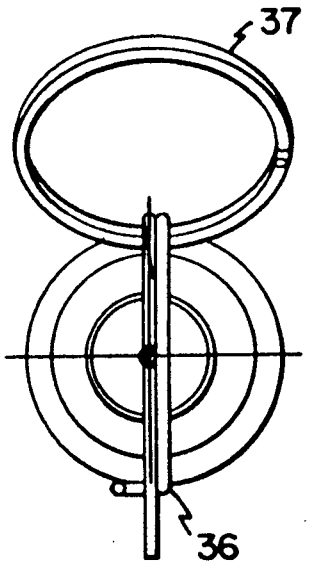

Referring now to the drawings, and particularly to FIG. 1*a*, the arrangement of one embodiment of a silent stud gun attachment device, in the unfired condition, is further explained.

The stud gun attachment device includes a barrel or, as it may otherwise be referred to, a housing 1, the barrel 1 has a cartridge chamber end 2 and a stud ejection end 3. The barrel may be manufactured from any structural materials capable of meeting the requirements of a particular attachment mission. Aluminum has been utilized in one particular reduction to practice, but should not be considered to be a limitation.

The cartridge chamber end 2 and the stud ejection end 3 are connected by an elongate bore 4 running between them. The bore 4 runs substantially parallel to a longitudinal axis 5 of the barrel 1. The bore 4 is cylindrical in one embodiment of the invention, but other bore 4 shapes are also possible.

One reduction to practice features a shoulder 6 at the stud ejection end 3 of the bore 4. The shoulder 6 is thought to assist in sealing the bore 4 and orienting the stud 7 when the stud gun is fired. The shoulder 6 also provides a smooth transition into the stud ejection opening 8.

The stud 7, or similar attachment projectile 7, is positioned in the bore 4 with penetration end 9 engaged in the stud ejection opening 8 of the barrel 1. The stud 7 may be made from a number of materials, in a variety of sizes or shapes depending on the exact method of propulsion, the nature of the structure to be penetrated, and other related factors. In one reduction to practice, a standard masonry nail was utilized as the stud 7. When fired into a concrete or concrete block structure, this embodiment of the invention required over 1,000 pounds of force to remove the attachment device from the structure.

The penetration end 9 of the stud 7 is able to pass through the stud ejection opening 8, however, the head 10, or piston contact end 10, of the stud 7 is not able to pass through the stud ejection opening 8. This prevents the stud 7 from being expelled from the gun, thereby greatly increasing the overall operational safety of the gun.

As can be seen from FIG. 1*a*, the combination of length of the stud 7 and the thickness of the stud ejection end 3 determine the maximum possible penetration depth of the stud 7.

A gas-tight seal is thought to be necessary or at least quite desirable between the stud 7 and the wall of the bore 4. In one reduction to practice, this seal was provided by an O-ring seal 11 placed around the shank 12 of the stud 7 between the shank 12 and the bore 4. The use of a gas-tight seal prevents propellant gases 43 from escaping to the external environment when the stud driver is fired.

The stud ejection opening 8 is also sealed from the external environment in order to prevent dirt, moisture or other foreign materials from entering the stud ejection opening 8 or the bore 4. One embodiment utilizes an adhesive sealant 13 to seal the stud ejection opening 8. The adhesive sealant 13 also locks the stud in place and prevents it from falling into said bore 4 if the gun is dropped, jarred or otherwise subjected to forces or vibrations during use and handling.

Figure 3A:
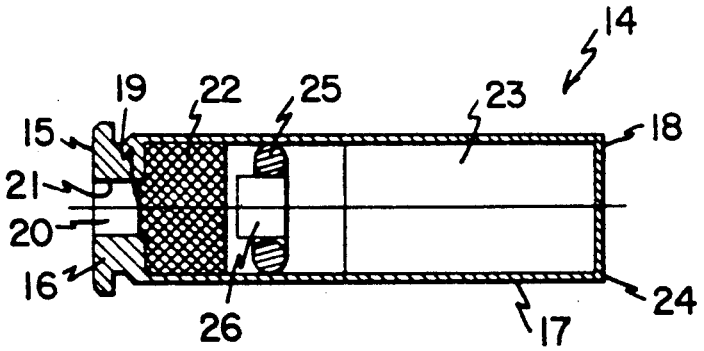
FIGS. 3*a* and 3*b* show a section view and an end view of one preferred embodiment of a cartridge according to the invention and is shown in the unfired condition.
Figure 3B:
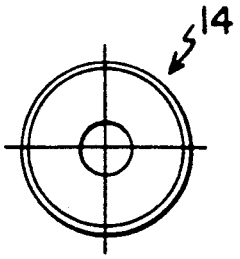

A propulsion means is necessary to propel the stud 7 into the target structure. Such means may include, without limitation, loose or compressed propellants located directly in the bore 4, or in a container positioned in the bore 4, explosives whether placed directly in the bore 4 or in a container, and other materials which can be induced to generate a propulsion thrust. One particular embodiment of this invention utilizes a .357 magnum cartridge as the propulsion means. FIG. 1*a* shows the orientation of the a cartridge assembly 14, or shell case assembly, in the bore 4 at the cartridge chamber end 2. FIG. 3*a* also depicts the cartridge assembly 14 in greater detail.

The cartridge assembly 14 utilizes a standard commercial cartridge case 15 such as a .357 magnum case having generally a base 16, a sidewall 17 and a rim 18. The base 16 is recessed and contains a through-hole 19 into the interior of the case. The primer 20 is located in the recessed area 21 of the base 16. The propellant 22 is located adjacent to the primer 20 within the sidewall 17. In one embodiment the piston 23 is crimped within the casing 15 at the rim 18 of the sidewall 17. The crimp 24 maintains the relative positions of the casing 15 and the piston 23. This is an important feature because this feature combined with the length of the barrel 1 and the location of the stud 7 also fixes the spacing of the stud 7 and the piston 23. This spacing effects the amount of force ultimately supplied to the stud 7 when the device is fired. In one reduction to practice, the piston 23 was made from sintered tungsten in an effort to further maximize the force supplied to the stud 7 when the stud gun is fired.

The piston 23 has a gas-tight seal with respect to the casing 15, and upon firing, with respect to the bore 4. In one preferred embodiment, the seal is accomplished by using an O-ring 25 attached to a necked-down end 26 of the piston 23 facing the propellant 22. Other methods of attaching the O-ring 25 to the piston 23 are also possible. The purpose of O-ring 25 is to prevent gases generated by the burning of propellant 22 from escaping from the bore 4. By containing the gas generated by propellant 22, O-rings 11 and 25 greatly reduce, or even silence, the noise which would otherwise be generated by the burning of propellant 22.

Returning to FIG. 1*a*, an initiation means is required to initiate the propulsion means. One embodiment which has been reduced to practice utilizes a stored-energy spring initiation device 27, however, many types of initiation devices are possible, this embodiment is not intended to be limiting.

The stored-energy spring initiation device utilizes a housing 28 which has been reduced to practice using aluminum, but is not limited to aluminum. The housing 28 has a hammer end 29 and a firing pin end 30.

The hammer end 29 and firing pin end 30 are connected by a bore 33. The housing 28 is attached to the barrel 1 at the cartridge chamber end 2. Several methods of attachment are possible. One preferred embodiment has utilized screw threads 31 on the housing 28 and the cartridge chamber end 2 of the barrel 1. A seal 32 in the attachment region is also necessary to prevent the escape of gases caused by burning the propellant 22. One embodiment has utilized the screw threads 31 to provide this seal 32.

At the hammer end 29, the hammer 34 is located in the bore 33. The hammer 34 may slide through an opening in the hammer end 29. The hammer 34 extends through a spring 35.

The hammer 34 is compressed against the spring 35 of FIG. 1*a* to store the energy necessary to initiate the primer 20. The hammer is held in place by a safety pin 36 which can be inserted through an opening perpendicular to the longitudinal axis 5 at the external end of the hammer 34. The locked safety pin 36 can be used with a split ring 37 to provide a double safing mechanism so as to guard against accidental discharge of the device.

On the firing pin end 30, a firing pin 38, which is aligned with the primer 20, extends through an opening in the housing 28. The firing pin 38 is able to slide in this opening in housing 28 in response to the impact of the hammer 34.

Figure 2:
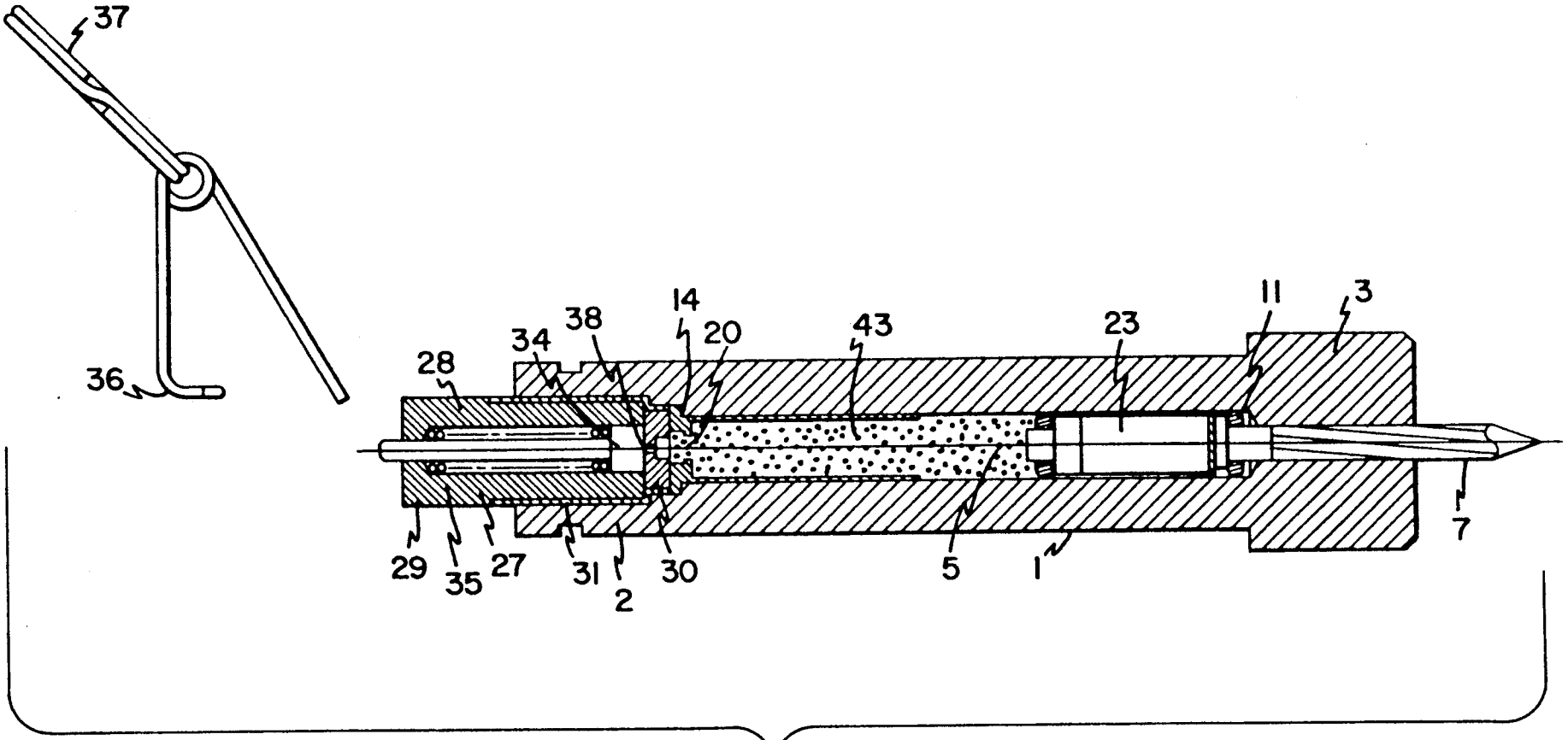
FIG. 2 shows a section view of one preferred embodiment of the silent stud gun attachment device according to the invention in the fired condition.
Figure 4A:
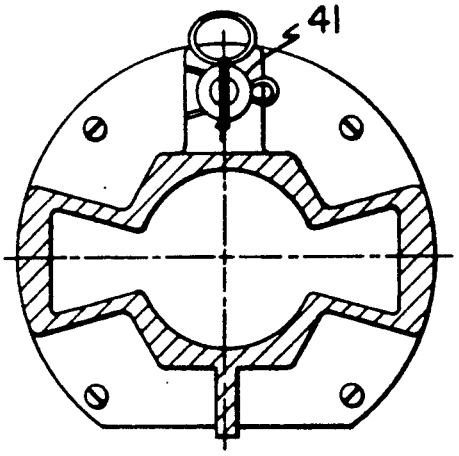
FIGS. 4*a* and 4*b* are a section view and an end view of one preferred embodiment of an article for attachment including a mating contour design to mate with the stud gun contour according to the invention and is shown in the unfired condition.
Figure 4B:
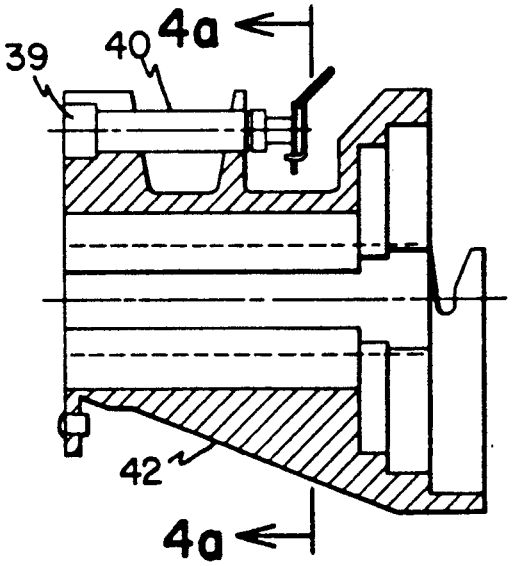

Referring now to FIGS. 2, 4*a* and 4*b*, a description is given of one embodiment of the operation of the silent stud gun attachment device. Referring to one embodiment of an article for attachment illustrated in FIGS. 4*a* and 4*b*, once the contour 39 at the stud ejection end 3 of stud gun 40 has been engaged in the mating contour 41 of the article 42 to be attached, the stud gun is ready for operation.

Referring to FIG. 2, the safety pin 36 may then be unlocked and the split ring 37 may be used to pull the safety pin 36 through the opening in the hammer 34, thereby allowing the spring 35 to thrust the hammer 34 into the firing pin 38. The firing pin 38 strikes the primer 20, thereby denting the primer 20 and causing the primer 20 to detonate into the propellant 22. The detonation of the primer 20 causes the propellant 22 to burn creating propellant gases 43. The pressure created by the propellant gas 43 drives the piston 23 down the bore 4 into the stud 7. The force of the impact of the piston 23 drives the stud 7 partially through the stud ejection opening 8 and into the structure of interest. The only sound generated is the sound of the piston 23 striking the stud 7 and the stud 7 striking the structure. From a distance of several feet, the sound is barely perceptible to a human.

What is claimed is:

1. A device for silently attaching an article to a structure, comprising:

(a) a barrel having a propulsion end, a substantially closed projectile ejection end and an elongate bore extending between said propulsion end and said projectile ejection end, said bore having a longitudinal axis and a cross-section, said bore terminating at said projectile ejection end in a projectile ejection opening, said projectile ejection opening having a cross-section which is smaller than said bore cross-section;

(b) an attachment projectile, said projectile having a propulsion end and a penetration end, said projectile being slidably positioned within said bore substantially parallel to said longitudinal axis, said penetration end being oriented toward said projectile ejection end within said bore and aligned with said projectile ejection opening, said penetration end having a cross-section smaller than said projectile ejection opening cross-section, said propulsion end having a cross-section larger than said projectile ejection opening cross-section such that said propulsion end is not able to pass through said projectile ejection opening; and (c) means for sealing between said bore and said projectile such that a propulsion gas may not escape from said propulsion end past said projectile and out through said projectile ejection opening.

2. The apparatus of claim 1, comprising means for sealing said projectile ejection opening of said barrel with respect to an external environment comprising dirt, moisture, and other foreign materials.

3. The apparatus of claim 1, further comprising propulsion means for propelling said projectile down said bore and driving said penetration end through said projectile ejection opening.

4. The apparatus of claim 3, further comprising means for initiating said propulsion means.

5. The apparatus of claim 4, further comprising means for attaching said initiation means and said propulsion means to said barrel at approximately said propulsion end.

6. The apparatus of claim 5, further comprising means for sealing said initiation means and said propulsion means with respect to said barrel so as to prevent the escape of said propulsion gas.

7. A stud gun for silently attaching an article to a structure, comprising:

(a) a barrel having a propulsion end, a substantially closed stud ejection end and an elongate bore extending between said propulsion end and said stud ejection end, said bore having a longitudinal axis and a cross-section, said bore terminating at said stud ejection end in a tapered shoulder, said shoulder opening into a stud ejection opening, said stud ejection opening having a cross-section which is smaller than said bore cross-section;

(b) a stud having a piston contact end and a penetration end, said stud being slidably positioned within said bore and substantially parallel to said longitudinal axis, said penetration end of said stud being engaged in said stud ejection opening, said piston contact end having a cross-section larger than said stud ejection opening such that said stud is not able to slide completely through said stud ejection opening;

(c) first means for providing a seal between said bore and said stud such that a propulsion gas may not escape from said propulsion end past said stud and out through said stud ejection opening;

(d) a piston having a propulsion end and a stud contact end, said piston being slidable positioned within said bore between said stud and said propulsion end;

(e) second means for providing a seal between said bore and said piston such that said propulsion gas may not escape from said propulsion end past said piston and out through said stud ejection opening;

(f) a propellant disposed within said bore at approximately said propulsion end;

(g) a propellant initiation device attached to said barrel at approximately said propulsion end;

(h) third means for providing a seal between said initiation device and said propulsion end of said barrel; and (i) fourth means for sealing said stud ejection opening of said barrel with respect to an external environment comprising dirt, moisture, and other foreign materials.

8. The apparatus of claim 7 wherein the propellant is disposed within a cartridge disposed within said bore, said cartridge comprising a casing and a primer, said casing having a base, a sidewall and a rim, said base having a recess with an opening which extends through said base, said primer being disposed within said recess over said opening, said propellant being disposed within said casing sidewall adjacent to said primer, said piston being disposed within said casing sidewall between said rim and said propellant, said casing having a crimp connection between said sidewall and said piston at approximately said rim, thereby maintaining the relative position of said piston within said casing.

9. The apparatus of claim 7, wherein said sealing means between said propellant initiation device and said barrel comprises a threaded connection.

10. The apparatus of claim 7, wherein said sealing means for said stud ejection opening is an adhesive sealant, said adhesive sealant being disposed in and sealing said stud ejection opening from said external environment.

11. The apparatus of claim 7, wherein said propellant initiation device is a stored-energy device comprising:

(a) a housing, said housing having a substantially closed hammer end and a substantially closed firing pin end, said housing having a bore extending between said hammer end and said firing pin end, said housing bore being approximately parallel to said longitudinal axis;

(b) a hammer slidably disposed within said bore and substantially parallel to said longitudinal axis, said hammer having an internal end and an external end, said internal end and said external end having cross-sections, said internal end cross-section being larger than said external end cross-section, said internal end having shoulder such that it may engage a spring, said external end being slidably aligned with and capable of extending through an opening in said hammer end, said external end of said hammer having a hole approximately perpendicular to said longitudinal axis and extending through said external end;

(c) a spring positioned between said hammer and said hammer ends; and (d) a firing pin slidably positioned in an opening in said firing pin end, said firing pin having a hammer end and a primer end, said hammer end being oriented toward said hammer.

12. The apparatus of claim 11, wherein said opening at said external end of said hammer has a safety pin inserted through said opening, wherein said safety pin retains said spring in a compressed or stored energy mode.

13. A stud gun for silently attaching an article to a structure, comprising:

(a) a barrel having a cartridge chamber end, a substantially closed stud ejection end and an elongate bore extending between said cartridge chamber end and said stud ejection end, said bore having a longitudinal axis and a cross-section, said bore terminating at said stud ejection end in a tapered shoulder, said shoulder opening into a stud ejection opening, said stud ejection opening having a cross-section which is smaller than said bore cross-section;

(b) a stud having a piston contact end and a penetration end, said stud being slidably positioned within said bore substantially parallel to said longitudinal axis, said stud having a seal with respect to said bore, said stud being oriented such that said penetration end is engaged in said stud ejection opening, said piston contact end having a cross-section larger than said stud ejection opening such that said stud will not slide from said bore completely through said stud ejection opening;

(c) a cartridge disposed within said bore at said cartridge chamber end of said barrel, said cartridge comprising a casing, a primer, a propellant and a piston, said casing having a base, a sidewall and a rim, said base having a recess, said recess having an opening through said base, said primer being disposed within said recess in said base over said opening, said propellant being disposed within said sidewall adjacent to said primer, said piston being disposed within said sidewall, said sidewall having a crimp approximately at said rim, thereby maintaining the relative position of said piston within said casing, said piston also having a seal which upon movement of the piston from the cartridge becomes a seal between said piston and said bore such that said seal will not permit a propellant gas to escape past said piston and out said stud ejection opening when said propellant is ignited;

(d) a primer initiation device attached to said cartridge chamber end of said barrel in close proximity to said primer;

(e) a seal sealing said primer initiation device, said cartridge and said cartridge chamber end of said barrel; and (f) a seal over said stud ejection opening sealing said stud ejection opening and said bore from an external environment including dirt, moisture and other foreign materials.

14. The apparatus of claim 13, wherein said stud seal is an O-ring affixed around said stud.

15. The apparatus of claim 13, wherein said piston seal is an O-ring affixed around said piston.

16. The apparatus of claim 13, wherein said piston is comprised of tungsten.

17. The apparatus of claim 13, wherein said cartridge is a .357 inch magnum cartridge.

18. The apparatus of claim 13, wherein said initiation device is a stored-energy spring device, comprising:

(a) a housing having a substantially closed hammer end and a substantially closed firing pin end, said housing having a bore extending between said hammer end and said firing pin end, said housing bore being approximately parallel to said longitudinal axis;

(b) a hammer slidably disposed within said bore and substantially parallel to said longitudinal axis, said hammer having an internal end and an external end, said internal end and said external end having cross-sections, said internal end cross-section being larger than said external end cross-section, said internal end having a shoulder such that it may engage a spring, said external end being slidably aligned with and capable of extending through an opening in said hammer end, said external end of said hammer having a hole approximately perpendicular to said longitudinal axis and extending through said external end;

(c) a spring positioned between said hammer and said hammer end; and (d) a firing pin, slidably positioned in an opening in said firing pin end, said firing pin having a hammer end and a primer end, said hammer end being oriented toward said hammer.

19. The apparatus of claim 13, wherein said seal between said primer initiation device, said cartridge and said barrel is a threaded connection between said primer initiation device and said barrel.

20. The apparatus of claim 13, wherein said seal over said stud ejection opening is accomplished using an adhesive sealant material.

21. The apparatus of claim 13, wherein said barrel has a contour on said stud ejection end, said contour matching the contour of an article to be attached by the stud gun, said contour and said mating contour being slidably engagable, the engagement of said contour and said mating contour fixing the relative positions of said stud driver and said article.

22. A stud driver for silently attaching an article to a structure, comprising:

(a) a barrel having an explosive chamber end, a stud ejection end and a bore extending between said explosive chamber end and said stud ejection end, said bore having a longitudinal axis and a cross-section, said bore terminating at said stud ejection end in a tapered shoulder, said shoulder opening into a stud ejection opening, said stud ejection opening having a cross-section which is smaller than said bore cross-section;

(b) a stud being having a propulsion end and a penetration end, said stud slidably positioned within said bore substantially parallel to said longitudinal axis, said stud having a seal between said stud and said bore so as to prevent an explosion shock wave from passing from said explosive chamber end past said stud and out through said stud ejection opening, said stud being oriented such that said penetration end is engaged in said stud ejection opening, said propulsion end having a cross-section larger than said stud ejection opening cross-section, so as to prevent said stud from sliding completely through said stud ejection opening;

(c) an explosive propellant disposed within said explosive chamber end;

(d) a detonation device attached to said barrel at said explosion chamber end, and having a seal between said barrel and said detonation device such that said explosive shock wave may not escape from said explosive chamber end; and (e) a seal sealing said stud ejection end from an external environment comprising dirt, moisture and other foreign materials.

* * * * *

UNITED STATES PATENT AND TRADEMARK OFFICE

CERTIFICATE OF CORRECTION

PATENT NO. : 5,038,665

DATED : August 13, 1991

INVENTOR(S) : Robert L. Aske and Thomas R. Prentice

It is certified that error appears in the above-identified patent and that said Letters Patent is hereby corrected as shown below:

Column 7, line 38, after "having" insert --a--.

Signed and Sealed this

Ninth Day of February, 1993

*Attest:*

STEPHEN G. KUNIN

*Attesting Officer*

*Acting Commissioner of Patents and Trademarks*